US008695838B1

(12) United States Patent
Montgomery

(10) Patent No.: US 8,695,838 B1
(45) Date of Patent: Apr. 15, 2014

(54) BOWL WITH UTENSIL HOLDER

(76) Inventor: Seana L. Montgomery, McKinney, TX (US)

( * ) Notice: Subject to any disclaimer, the term of this patent is extended or adjusted under 35 U.S.C. 154(b) by 0 days.

(21) Appl. No.: 13/490,364

(22) Filed: Jun. 6, 2012

(51) Int. Cl.
*B65D 6/00* (2006.01)

(52) U.S. Cl.
USPC ..... 220/574.1

(58) Field of Classification Search
USPC ..... 220/574.1, 574, 556, 735, 831, 832, 220/833; 206/541, 223, 562, 564
See application file for complete search history.

(56) References Cited

U.S. PATENT DOCUMENTS

| | | | | |
|---|---|---|---|---|
| 269,054 | A | * 12/1882 | Hemsteger | 220/574 |
| D25,316 | S | 3/1896 | Dobson | |
| 676,799 | A | 6/1901 | McLoughlin | |
| 785,116 | A | 3/1905 | Perry | |
| D47,282 | S | 5/1915 | Beurmann | |
| 1,673,677 | A | 5/1921 | Holland | |
| 1,505,675 | A | 8/1924 | Stirn | |
| D109,508 | S | 5/1938 | Wood | |
| D113,856 | S | 3/1939 | Smith | |
| D117,054 | S | 10/1939 | Bradford | |
| 2,261,448 | A | 11/1941 | Petersen | |
| 2,350,475 | A | 6/1944 | Rabezzana | |
| D162,354 | S | 3/1951 | Smith | |
| D167,942 | S | 10/1952 | Jones | |
| 2,655,016 | A | 10/1953 | Hudson | |
| 3,033,945 | A | 5/1962 | Villchur | |
| D195,345 | S | 6/1963 | Stageberg | |
| 3,193,309 | A | 7/1965 | Morris | |
| 3,824,742 | A | 7/1974 | Rupp | |
| D245,384 | S | 8/1977 | Ashton | |
| 4,225,162 | A | 9/1980 | Dola | |
| D270,887 | S | 10/1983 | Allgeyer et al. | |
| D275,925 | S | 10/1984 | Bowen et al. | |
| D286,399 | S | 10/1986 | Willy | |
| 4,834,328 | A | 5/1989 | Hall | |
| 4,873,795 | A | 10/1989 | Spiess et al. | |
| 4,921,447 | A | 5/1990 | Capp et al. | |
| 4,940,199 | A | 7/1990 | Hall | |
| 4,968,010 | A | 11/1990 | Odobasic | |
| 4,978,567 | A | 12/1990 | Miller | |
| D318,428 | S | 7/1991 | Kowk | |
| 5,185,499 | A | 2/1993 | Yahraus | |
| 5,195,756 | A | 3/1993 | Wachter | |

(Continued)

OTHER PUBLICATIONS

U.S. Appl. No. 29/428,184 entitled "Bowl With Utensil Retention Feature", inventor Seana L. Montgomery, filed Jul. 27, 2012.

(Continued)

*Primary Examiner* — Steven A. Reynolds
*Assistant Examiner* — King M Chu
(74) *Attorney, Agent, or Firm* — Patent Capital Group

(57) ABSTRACT

In an example embodiment, a container is provided that includes a circular rim having a recess, where the container has a depth defined by a sidewall and an inner bottom surface. The container also includes a clasp configured to extend across the recess in order to inhibit movement of an object that rests on a surface of the recess. In other example implementations, the clasp operates in a first configuration when a downward force is applied to the clasp and against the circular rim such that the object is secured within the recess. In addition, the clasp can operate in a second configuration when a downward force is applied to the clasp and against the circular rim such that the clasp is secured in a groove of the container.

18 Claims, 7 Drawing Sheets

(56) References Cited

U.S. PATENT DOCUMENTS

| | | | | |
|---|---|---|---|---|
| D337,005 | S | 7/1993 | Culverhouse | |
| D351,088 | S | 10/1994 | Hsiao | |
| 5,388,732 | A | 2/1995 | Greger | |
| 5,390,816 | A | 2/1995 | Boyd | |
| D358,062 | S | 5/1995 | Hasuike | |
| 5,413,502 | A | 5/1995 | Wang | |
| D369,727 | S | 5/1996 | Ancona | |
| D372,286 | S | 7/1996 | Fortini | |
| 5,532,073 | A | 7/1996 | Hirata et al. | |
| D378,578 | S | 3/1997 | Eberhardt | |
| 5,638,981 | A | 6/1997 | Crane | |
| D383,031 | S | 9/1997 | Cousins | |
| D386,042 | S | 11/1997 | Miller | |
| D391,118 | S | 2/1998 | Jørgensen | |
| D405,656 | S | 2/1999 | Davis et al. | |
| 5,915,580 | A | 6/1999 | Melk | |
| 5,922,993 | A | 7/1999 | Ide et al. | |
| 5,972,009 | A | 10/1999 | Fortier et al. | |
| D419,395 | S | 1/2000 | Swanson | |
| D423,621 | S | 4/2000 | Holtby | |
| D438,050 | S | 2/2001 | Huntinger | |
| D440,501 | S | 4/2001 | Dorion et al. | |
| D442,304 | S | 5/2001 | Huang | |
| D443,181 | S | 6/2001 | Miller | |
| 6,331,123 | B1 | 12/2001 | Rodrigues | |
| D455,599 | S | 4/2002 | Cheng | |
| 6,457,601 | B1 | 10/2002 | Chappell | |
| D473,752 | S | 4/2003 | Kerr | |
| D477,367 | S | 7/2003 | Gaines et al. | |
| 6,604,714 | B1 | 8/2003 | Hall | |
| D482,575 | S | 11/2003 | Mountain | |
| D484,690 | S | 1/2004 | Vazquez | |
| D492,538 | S | 7/2004 | Cheng | |
| 6,886,707 | B2 * | 5/2005 | Giraud | 220/254.4 |
| D509,403 | S | 9/2005 | Raydo | |
| D509,994 | S | 9/2005 | Hadland | |
| D512,599 | S | 12/2005 | Hoenstein | |
| 6,990,893 | B2 | 1/2006 | Cheng | |
| D522,313 | S | 6/2006 | Oyler et al. | |
| D524,603 | S | 7/2006 | Kishbaugh et al. | |
| D539,611 | S | 4/2007 | Wasserman et al. | |
| D541,104 | S | 4/2007 | Barber | |
| D546,117 | S | 7/2007 | Orr | |
| D547,614 | S | 7/2007 | Kell | |
| D560,434 | S | 1/2008 | Feil | |
| D562,060 | S | 2/2008 | Kloppsteck | |
| D564,302 | S | 3/2008 | Freeman | |
| D565,357 | S | 4/2008 | Chan | |
| D568,677 | S | 5/2008 | Stattmann | |
| D579,715 | S | 11/2008 | Pawson et al. | |
| D586,177 | S | 2/2009 | Loring | |
| D590,203 | S | 4/2009 | Gates | |
| D592,064 | S | 5/2009 | Kilany | |
| D592,512 | S | 5/2009 | Dubitsky et al. | |
| D593,807 | S | 6/2009 | Kong | |
| D599,164 | S | 9/2009 | Hoekstra | |
| D600,497 | S | 9/2009 | Ek | |
| D603,211 | S | 11/2009 | Ek | |
| 7,631,781 | B2 | 12/2009 | Chen | |
| D608,149 | S | 1/2010 | Kellermann | |
| D611,769 | S | 3/2010 | Hauser | |
| D613,616 | S | 4/2010 | Renz et al. | |
| D617,609 | S | 6/2010 | Thomas | |
| D617,610 | S | 6/2010 | Thomas | |
| D618,494 | S | 6/2010 | Welk et al. | |
| D618,495 | S | 6/2010 | Welk et al. | |
| D625,469 | S | 10/2010 | Dubitsky et al. | |
| D627,198 | S | 11/2010 | Hull et al. | |
| D630,891 | S | 1/2011 | Thonis | |
| D631,204 | S | 1/2011 | Dubitsky et al. | |
| D635,229 | S | 3/2011 | DuFour | |
| D639,115 | S | 6/2011 | Stewart et al. | |
| D639,449 | S | 6/2011 | Luburic | |
| D641,590 | S | 7/2011 | Koennecke | |
| D642,868 | S | 8/2011 | Shah | |
| 7,992,714 | B1 | 8/2011 | DeVault et al. | |
| D647,199 | S | 10/2011 | Kroiss | |
| D650,005 | S | 12/2011 | Perks | |
| D650,006 | S | 12/2011 | Perks | |
| D656,792 | S | 4/2012 | Sink et al. | |
| D657,624 | S | 4/2012 | Kastl | |
| D659,913 | S | 5/2012 | Spectre et al. | |
| 8,167,129 | B2 | 5/2012 | Hatcher | |
| 8,172,612 | B2 | 5/2012 | Bence et al. | |
| 8,192,237 | B2 | 6/2012 | Purdy et al. | |
| D664,399 | S | 7/2012 | Henry | |
| 8,216,315 | B2 | 7/2012 | Ralph et al. | |
| D665,228 | S | 8/2012 | Rosen | |
| 8,251,340 | B2 | 8/2012 | Webb et al. | |
| D666,458 | S | 9/2012 | Montgomery | |
| D672,192 | S | 12/2012 | Zibilich | |
| 8,322,112 | B2 | 12/2012 | Luburic | |
| D676,712 | S | 2/2013 | Montgomery | |
| D677,124 | S | 3/2013 | Montgomery | |
| D677,125 | S | 3/2013 | Montgomery | |
| D677,126 | S | 3/2013 | Montgomery | |
| D677,519 | S | 3/2013 | Montgomery | |
| D680,808 | S | 4/2013 | Montgomery | |
| D684,420 | S | 6/2013 | Montgomery | |
| D684,822 | S | 6/2013 | Montgomery | |
| 2003/0015018 | A1 | 1/2003 | Brannon et al. | |
| 2004/0026429 | A1 * | 2/2004 | Baldewsingh et al. | 220/574.1 |
| 2005/0115974 | A1 * | 6/2005 | Micciulla | 220/574 |
| 2008/0149634 | A1 * | 6/2008 | Osborne | 220/23.83 |
| 2009/0241347 | A1 | 10/2009 | Weaver | |
| 2009/0321455 | A1 | 12/2009 | Fernandez et al. | |
| 2010/0078350 | A1 * | 4/2010 | Raynor | 206/564 |
| 2011/0073610 | A1 * | 3/2011 | Giraud et al. | 220/833 |

OTHER PUBLICATIONS

U.S. Appl. No. 29/428,185 entitled "Bowl With Utensil Retention Feature", inventor Seana L. Montgomery, filed Jul. 27, 2012.
U.S. Appl. No. 29/428,187 entitled "Bowl With Utensil Retention Feature", inventor Seana L. Montgomery, filed Jul. 27, 2012.
U.S. Appl. No. 29/428,188 entitled "Bowl With Utensil Retention Feature", inventor Seana L. Montgomery, filed Jul. 27, 2012.
U.S. Appl. No. 29/428,189 entitled "Bowl With Utensil Retention Feature", inventor Seana L. Montgomery, filed Jul. 27, 2012.
U.S. Appl. No. 29/428,215 entitled "Bowl With Utensil Retention Feature", inventor Seana L. Montgomery, filed Jul. 27, 2012.
U.S. Appl. No. 29/428,221 entitled "Bowl With Utensil Retention Feature", inventor Seana L. Montgomery, filed Jul. 27, 2012.
U.S. Appl. No. 29/428,222 entitled "Bowl With Utensil Retention Feature", inventor Seana L. Montgomery, filed Jul. 27, 2012.
U.S. Appl. No. 29/428,225 entitled "Bowl With Utensil Retention Feature", inventor Seana L. Montgomery, filed Jul. 27, 2012.
U.S. Appl. No. 29/428,227 entitled "Bowl With Utensil Retention Feature", inventor Seana L. Montgomery, filed Jul. 27, 2012.
U.S. Appl. No. 29/428,232 entitled "Bowl With Utensil Retention Feature", inventor Seana L. Montgomery, filed Jul. 27, 2012.
U.S. Appl. No. 29/428,240 entitled "Bowl With Utensil Retention Feature", inventor Seana L. Montgomery, filed Jul. 27, 2012.
U.S. Appl. No. 29/428,244 entitled "Bowl With Utensil Retention Feature", inventor Seana L. Montgomery, filed Jul. 27, 2012.
U.S. Appl. No. 29/428,248 entitled "Bowl With Utensil Retention Feature", inventor Seana L. Montgomery, filed Jul. 27, 2012.
U.S. Appl. No. 29/428,253 entitled "Bowl With Utensil Retention Feature", inventor Seana L. Montgomery, filed Jul. 27, 2012.
U.S. Appl. No. 29/428,256 entitled "Bowl With Utensil Retention Feature", inventor Seana L. Montgomery, filed Jul. 27, 2012.
U.S. Appl. No. 29/428,261 entitled "Bowl With Utensil Retention Feature", inventor Seana L. Montgomery, filed Jul. 27, 2012.
U.S. Appl. No. 29/428,270 entitled "Bowl With Utensil Retention Feature", inventor Seana L. Montgomery, filed Jul. 27, 2012.
U.S. Appl. No. 29/428,276 entitled "Bowl With Utensil Retention Feature", inventor Seana L. Montgomery, filed Jul. 27, 2012.
U.S. Appl. No. 29/428,279 entitled "Bowl With Utensil Retention Feature", inventor Seana L. Montgomery, filed Jul. 27, 2012.

* cited by examiner

BOWL WITH UTENSIL HOLDER

TECHNICAL FIELD

This disclosure relates in general to the field of containers and, more particularly, to a bowl with utensil holder.

BACKGROUND

Bowls for use with soups, salads, desserts, and other foodstuffs are commonplace in many cultures. Typically, the bowls are used in conjunction with utensils (spoons, forks, ladles, etc.), for example, to scoop up the contents of the bowl. Usually, the utensil is long enough to fit into the bowl, where its handle can rest on a rim (i.e., an edge) of the bowl. The spoon and the bowl are independent articles. In scenarios where the bowl is being held in a consumer's hand(s), or is being used on a moving or vibrating surface (e.g., a table in a moving train, a plane, an automobile, etc.), there is a high chance that the spoon may slide off the bowl's edge and, thereby, spill the bowl's contents. Hence, there is a need to stabilize utensils (at least temporarily) in conjunction with handling a bowl to avoid such undesirable scenarios.

BRIEF DESCRIPTION OF THE DRAWINGS

To provide a more complete understanding of the present disclosure and features and advantages thereof, reference is made to the following description, taken in conjunction with the accompanying figures, wherein like reference numerals represent like parts, in which.

DETAILED DESCRIPTION OF EXAMPLE EMBODIMENTS

Overview

In an example embodiment, a container is provided that includes a circular rim (e.g., an edge, a perimeter, a surface, etc.) having a recess (e.g., a void, a hollowed out portion, a groove, an indentation, a carve out, a cavity, etc.). The container can have a depth defined by a sidewall and an inner bottom surface of the container. For example, the sidewall and the inner bottom surface of the container can define a certain height, or be indicative of a volume (capacity) associated with placing foodstuff within the container.

The container can also include a clasp configured to extend across the recess in order to inhibit movement of an object that rests on a surface of the recess. For example, the clasp can inhibit the movement of a utensil that rests in the recess. In other example implementations, the clasp operates in a first configuration when a downward force is applied to the clasp (and against the circular rim) such that the object is secured within the recess. In addition, the clasp can operate in a second configuration when a downward force is applied to the clasp (and against the circular rim) such that the clasp is secured in a groove of the container. This latter second configuration can be viewed as an open position for the clasp, whereas the first configuration can be viewed as a closed position for stabilizing the object.

The clasp can be hinged and rotatable between a first configuration associated with the recess being closed, and a second configuration associated with the recess being open and ready to receive the object. The circular rim can include a groove (e.g., a notch, a divot, a nick, etc.) configured to receive a lip on the clasp such that in a first configuration, the lip is engaged with the groove. The circular rim includes an additional groove configured to receive the lip such that in a second configuration, the lip is engaged with the additional groove.

The clasp can include a spring (e.g., a leaf spring) configured to press against an object placed in the recess. In yet other implementations, the clasp can include an arm that includes a first prong, a second prong (where the first prong and the second prong include a hollow space), and a sheet positioned between the first prong and the second prong in the hollow space such that the sheet can float up and down. In certain example embodiments, a magnetic material can be disposed on at least a portion of the inner bottom surface. In addition, at least a portion of the inner bottom surface can be uneven for receiving a head portion of the object. As used herein, the term 'uneven' is meant to encompass any type of undulation, hollowing out, curvature, depression, recess, etching, etc. that may be conducive for receiving a head of an object. For example, the uneven portion can receive the head of a spoon, while the other end of the spoon is resting in the recess of the circular rim.

Example Embodiments

Figure 1A:
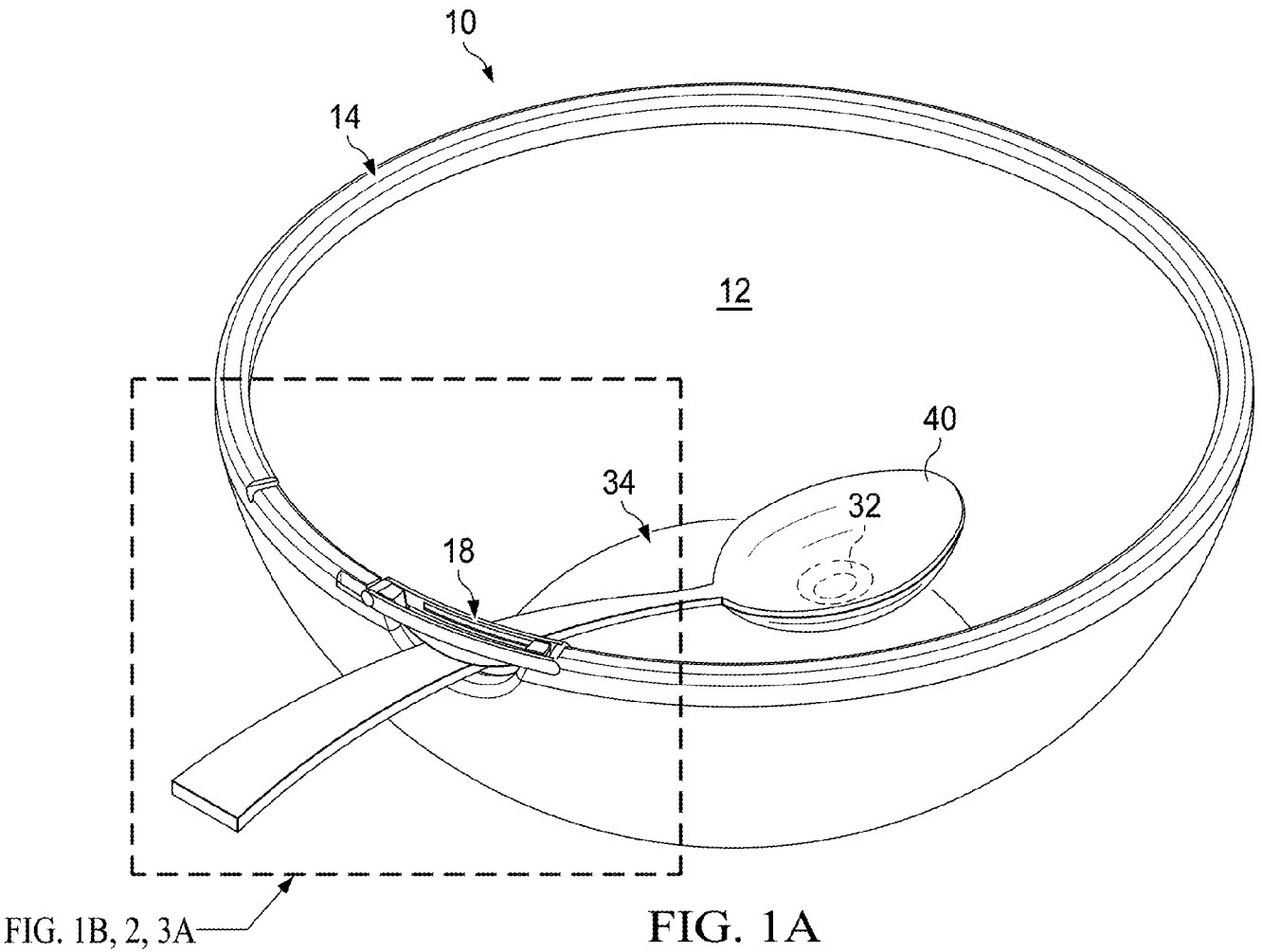
FIG. 1A is a simplified perspective view illustrating components of a system including a bowl with spoon holder according to an example embodiment.

FIG. 1A is a simplified perspective view illustrating components of a system 10 comprising a bowl 12 according to an example embodiment of the present disclosure. Bowl 12 may include a rim 14 having a recess 16. As used herein, the term "container" may include any vessel, bowl, pot, pan, cup, can, cavity, kitchenware generally, or any other object (having any appropriate shape, dimension, size, etc.) that can hold materials (e.g., dry materials, fluid materials, edible materials, paint supplies, construction supplies more generally, etc.). As used herein, the term "recess" may include a cut-out, nick, groove, etching, void, indentation, etc. carved out from (or shaped within the wall of) bowl 12. Recess 16 may be of any shape, including circular, oval, teeth design, rectangular, v-shaped, etc. As used herein, the term "rim" may include a brim, an edge, a lip, a perimeter, or any suitable outer boundary of bowl 12. Rim 14 may or may not include features such as screw threads, rivets, pins, multiple lips, indents, or other features. A clasp 18 can be configured to extend over recess 16 in a first configuration and, potentially, locked onto rim 14 in a certain closed configuration.

Figure 1B:
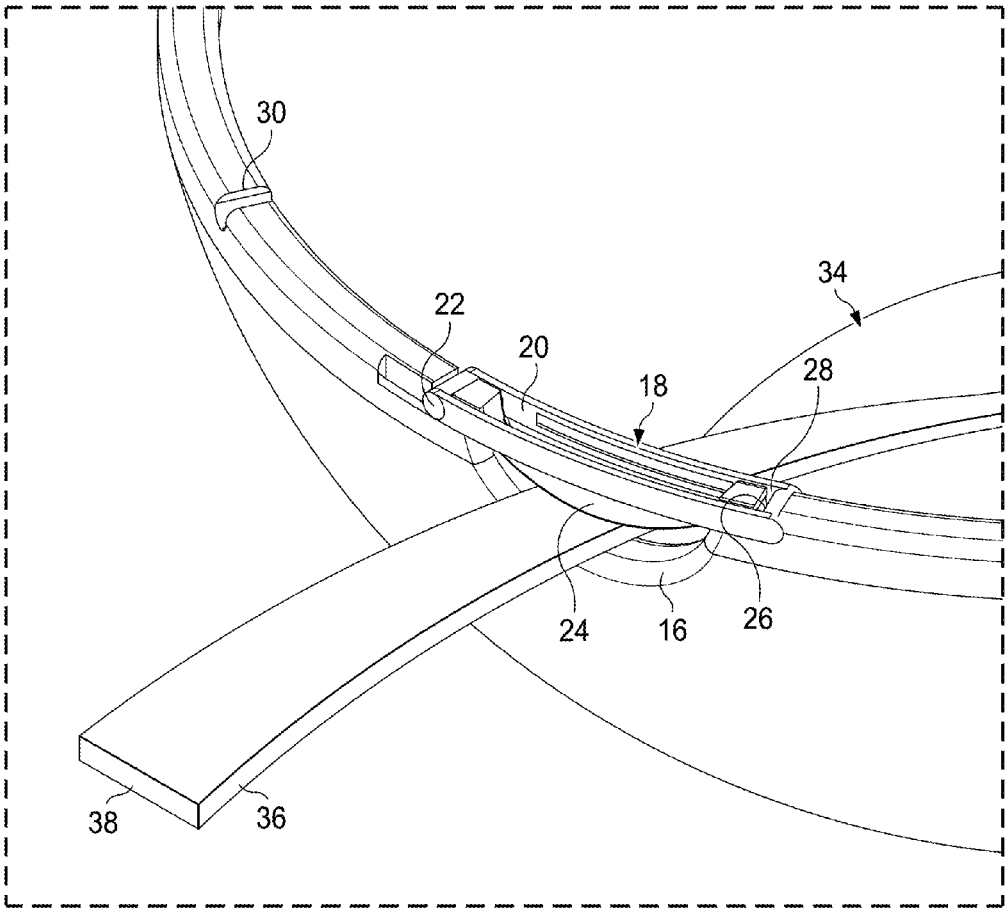
FIG. 1B is a simplified perspective view illustrating example details of the system of FIG. 1A.

FIG. 1B illustrates additional details associated with clasp 18. Clasp 18 can include an arm 20, which may be connected by a hinge 22 to rim 14. Clasp 18 may also include a spring 24 and a lip 26. Rim 14 may include several grooves 28 and 30 on either side of recess 16: each configured to receive lip 26, such that when lip 26 is engaged in either one of grooves 28 or 30, clasp 18 is secured into position. In some embodiments, bowl 12 may also include an indent 32 on an inner bottom surface 34. Indent 32 may include a magnetic material disposed on its surface, or provided internally to the bottom portion of bowl 12. In various embodiments, bowl 12 may be configured to receive an object 36. In an example embodiment, object 36 is a utensil having a handle 38 and a head 40. Additionally, the utensil may be formed of material that is attracted to the magnetic material disposed on bowl 12. This could operate, for example, to stabilize ahead of the utensil as it is being manipulated by a given user. In certain instances, an enhanced magnetic coating may be provided to the utensil such that the magnetic material of the bowl and the utensil are suitably mated (e.g., sold as a single unit in a retail environment). Additionally, and along similar lines, the object handle may be suitably mated with a particular recess shaping such that a snapping into place can occur. For example, a spoon may have a certain rectangular shape, where the recess may be designed in a rectangular fashion: specifically, for receiving such a shape and snapping this utensil into place.

During operation, arm 20 may be rotated around hinge 22 so that object 36 can be placed in bowl 12 with handle 38 positioned in recess 16 and head 40 positioned in indent 32. In a first configuration, clasp 18 may be locked by snapping lip 26 into groove 28. In the first configuration, spring 24 may press against object 36, holding object 36 securely in position. Pressure of spring 24 may hold object 36 snugly and securely so that there is limited relative movement between object 36 and bowl 12. Indent 32 may also facilitate locking object 36 into position, for example, preventing any pivoting around recess 16. Any movement (e.g., vibration, sliding, jarring, falling, rolling) of the bowl would not necessarily disturb object 36 from maintaining position. Clasp 18 may be unlocked by disengaging lip 26 from groove 28, for example, by pulling arm 20 upward. In a second configuration, clasp 18 may be locked by snapping lip 26 into groove 30. In the second configuration, object 36 may be unlocked from its locked position and used, for example, to scoop any contents (not shown) within bowl 12. Hinge 22 may be any kind of hinge, including butterfly hinge, flush hinge, barrel hinge, and other kinds or combination of hinges.

In various embodiments, recess 16 may be deep enough to receive object 36, but not so deep that bowl 12 cannot be used effectively as a container. In various embodiments, grooves 28 and 30 may be smaller in width and depth than recess 16 and, further, may be configured to snap lip 26 into position. As used herein, the term "groove" includes channels, notches, carved out portions, and any other type of indent that can be provided along rim 14. Grooves 28 and 30 may be of sufficient depth to engage lip 26, and maintain clasp 18 in a locked configuration, while being shallow enough to permit clasp 18 to be unlocked easily (e.g., with a flick of a finger). In various embodiments, arm 20 may be of any shape and cross-section, including solid, hollow, I-shaped, U-shaped, and H-shaped. For example, arm 20 may include two separate prongs connected together at hinge 22 and lip 26. In another example, arm 20 may additionally include a thin sheet (e.g., of aluminum) that is attached to, and rests between, the two separate prongs. In various embodiments, curvature of arm 20 may be configured to match bowl 12.

In various embodiments, spring 24 may be a leaf spring that is permanently attached to arm 20. Other spring types (e.g., coil, split wire) or compressible elastic materials (e.g., foam, rubber, plastic, etc.) may also be used within the broad scope of the embodiments presented herein. Clasp 18 may have generally any size and shape (e.g., curved, straight, thick, thin) that permits operation as disclosed herein. In some embodiments, clasp 18 is configured to blend aesthetically with the rest of rim 14 in a streamlined fashion (e.g., such that it is almost imperceptible). For example, clasp 18 may be curved, thin, and colored in the same color as rim 14, and may lay flush against rim 14. In other embodiments, rim 14 may include a metal coating, and clasp 18 may be fabricated out of metallic materials of a similar type.

In general, bowl 12, clasp 18, and object 36 may be made of any material (e.g., metal, wood, plastic, ceramic, polyurethanes and rubbers, etc.) or any suitable combination thereof. In one example embodiment, rim 14 and clasp 18 may be constructed of metal, while the rest of bowl 12 may be constructed of ceramic material. In another embodiment, clasp 18 may include magnetic materials, and the recess may be coated with (or made of) magnetic materials, for example, to be used in conjunction with object 36. In such a scenario, object 36 may be made of a material (e.g., metal alloy, steel, etc.) that may be attracted to magnetic materials.

Embodiments of system 10 may have a variety of applications. For example, embodiments of system 10 may be used in camping, for example, to allow a camper to eat cleanly without a table for supporting the spoon or the bowl. In such scenarios, the bowl may move as the camper holds the bowl in his or her hands. Clasp 18 may be easily placed in the first configuration during such movements (e.g., camper may lock clasp 18 with a flick of a finger), so that the spoon is inhibited from movement. In another example, bowl 12 may be used in an airplane to serve food to travelers. As the plane experiences turbulence, a traveler could quickly and conveniently lock the spoon into place, preventing the spoon from unwanted movement. Additionally, stabilizing the utensil in conjunction with the bowl can provide safety features in scenarios that involve serving hot dishes, which could potentially burn a consumer's skin if the utensil and/or bowl were to be jostled.

In yet another example application, bowl 12 is a paint can or bucket, while object 36 is a brush. As the painter moves from one location to another, the brush may be securely fastened to the paint can using clasp 18. Example embodiments of the present disclosure may further include paint rollers, where clasp 18 would be secured to the side of a paint tray. As noted previously, there can be proprietary combinations of objects and recess designs. This could be particularly applicable for paintbrushes (e.g., that have an opening at the end of the handle), which can be secured within a recess that is specifically designed for that type of paintbrush. In yet other applications, bowl 12 is a coffee mug and object 36 is a spoon for stirring contents within the coffee mug.

Figure 2:
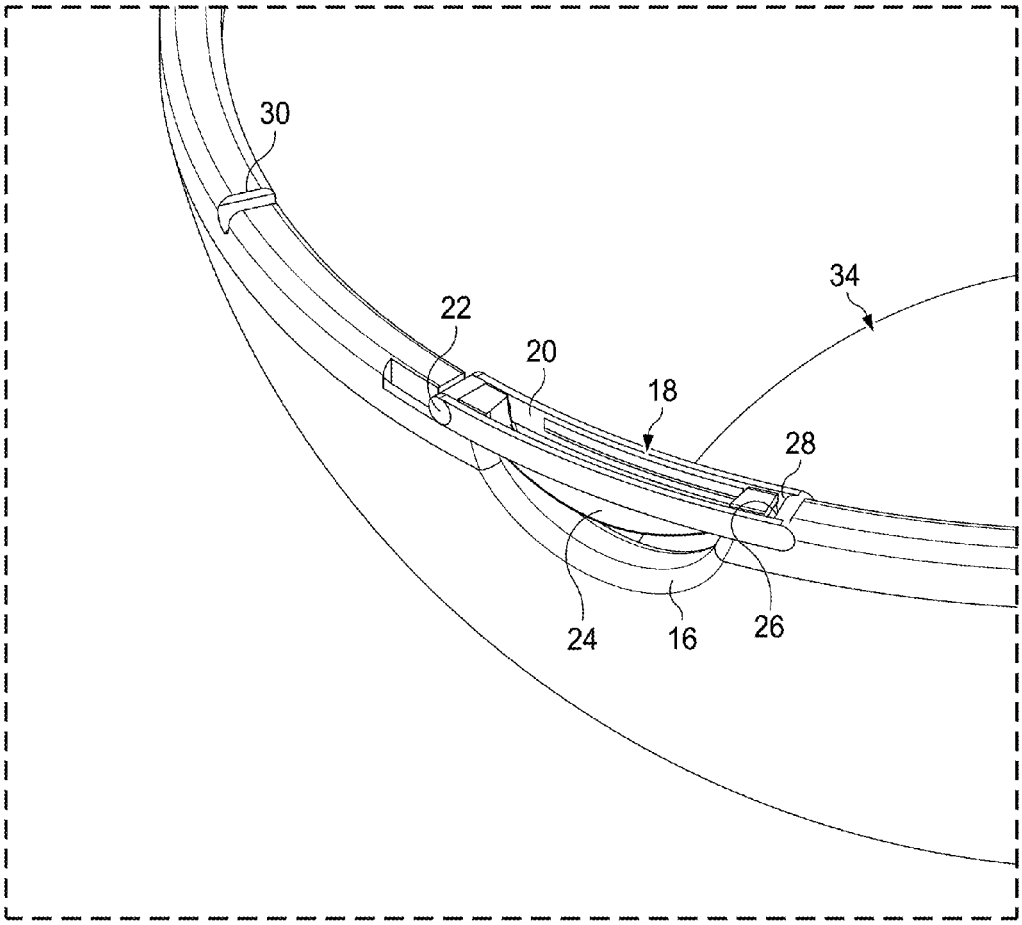
FIG. 2 is a simplified perspective view illustrating details of the bowl in an example embodiment.
Figure 3A:
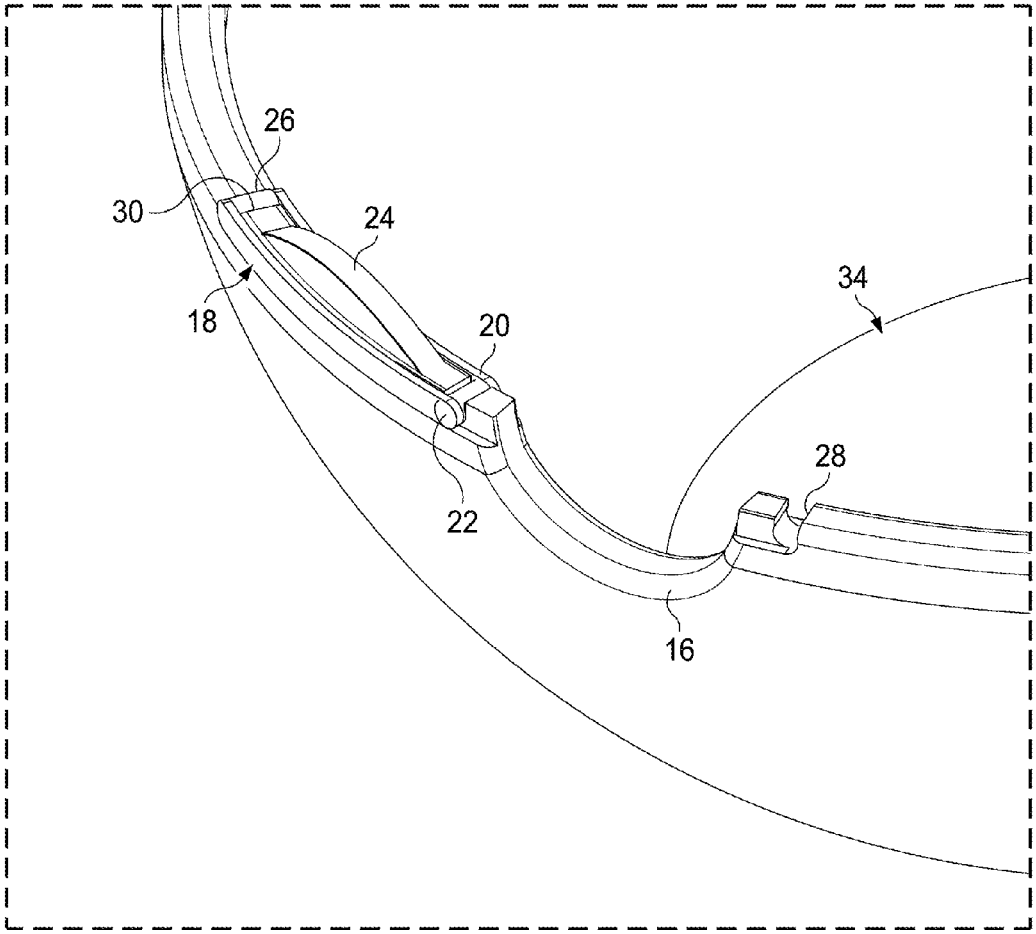
FIG. 3A is a simplified perspective view illustrating details of the bowl in another example embodiment.

Turning to FIG. 2, FIG. 2 illustrates a first configuration of bowl 12 according to an example embodiment. In the first configuration, clasp 18 is locked into position when lip 26 is engaged with groove 28. Hinge 22 enables clasp 18 to be hingedly connected to rim 14. In the first configuration, recess 16 is closed, and may prevent object 36 from being placed in recess 16. FIG. 3A illustrates a second configuration of bowl 12 according to an example embodiment. In the second configuration, clasp 18 may be locked into position with lip 26 is engaged with groove 30. In the second configuration, recess 16 may be opened up, and object 36 may be placed therein.

Figure 3B:
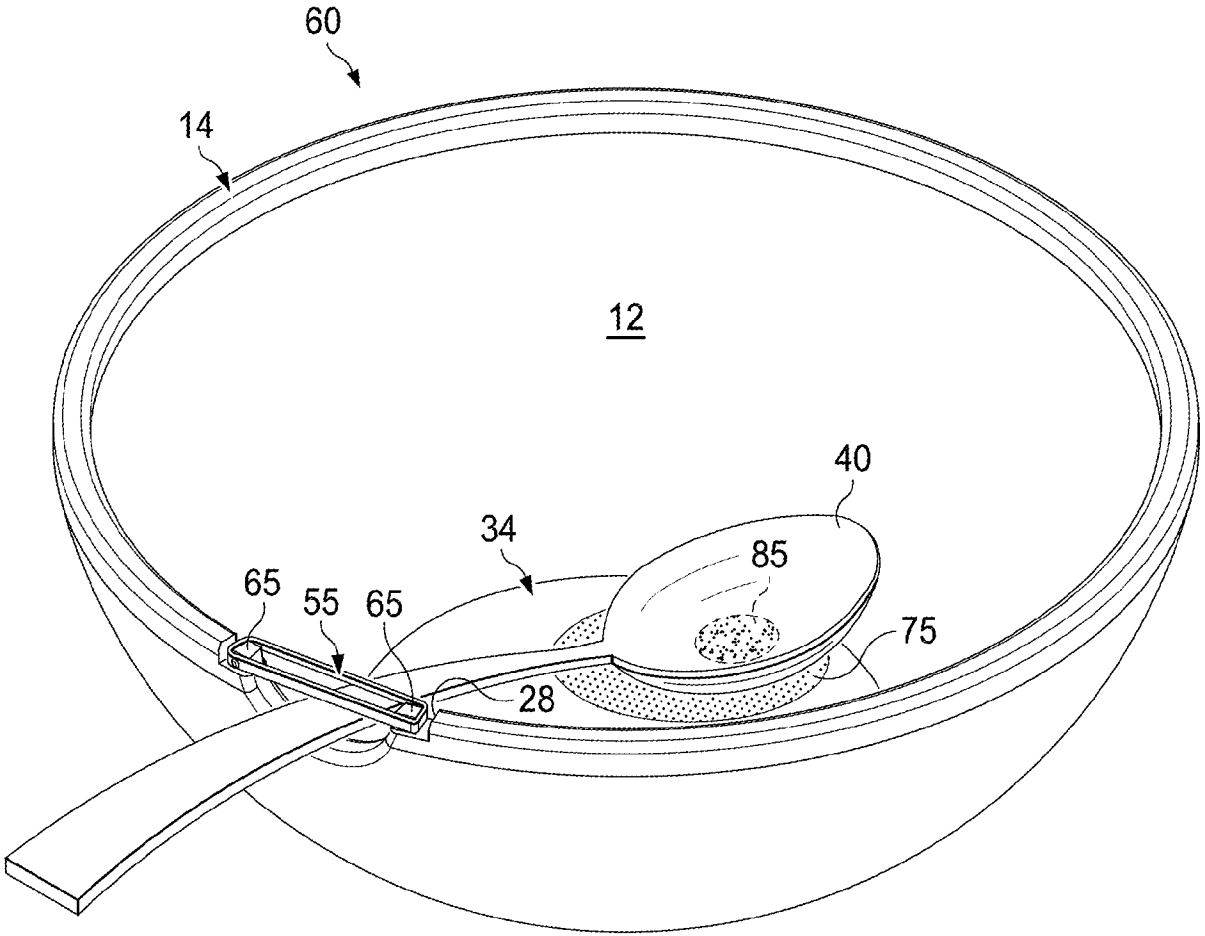
FIG. 3B is a simplified perspective view illustrating example details of the bowl in another example embodiment.

FIG. 3B illustrates another example configuration associated with the present disclosure. In this particular instance, an alternative system 60 is being depicted in which a band 55 is being used to inhibit movement of an object. Band 55 may be constructed of rubber, plastic, cloth or fabric, steel, a metal alloy, etc. such that it is operable to inhibit movement of object 36. In one example, band 55 is secured at one end by a rivet, although other securing mechanisms could equally be used. In other examples, band 55 may be less permanent, where a simple rubber band could be used in conjunction with two notches (e.g., ears) along the circular rim.

Band 55 may be stretched, expanded, lengthened, looped over, pulled taut, elongated, or otherwise extended across the recess such that it is coupled to a notch 65 and, thereby, secured. In this particular implementation, object 36 includes a magnetic surface 85 disposed on at least one surface. The surface could be the bottom of object 36, the top of object 36, both, or provided internally to object 36. Inner bottom surface 34 of bowl 12 similarly includes a magnetic coating 75 that attracts object 36 to a certain area of inner bottom surface 34, or the bowl more generally. As described above with reference to object 36, magnetic coating 75 may be disposed on inner surface of bowl 12, or provided internally to bowl 12.

Figure 4:
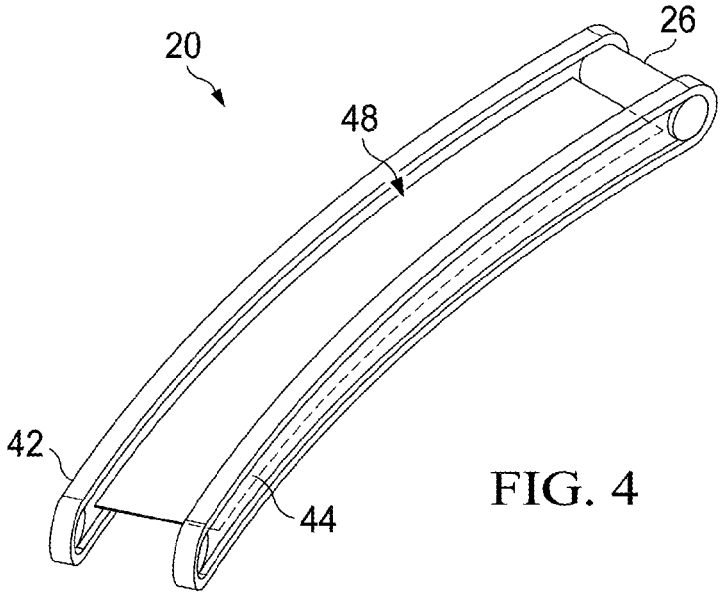
FIG. 4 is a simplified block diagram illustrating example details of an embodiment of bowl.

Turning to FIG. 4, FIG. 4 is a simplified block diagram illustrating example details of arm 20 according to an embodiment of system 10. Arm 20 may include two prongs 42 and 44 with a relatively thin sheet 48 in between these elements. Lip 26 may be attached on one end of arm 20 (e.g., away from hinge 22). Sheet 48 may move up and down and rest in the middle of prongs 42 and 44, thereby allowing play to position object 36 in recess 16. For example, when lip 26 is engaged in groove 28, sheet 48 may be positioned towards an upper portion of prongs 42 and 42, away from bowl 12. When clasp 18 is unlocked, sheet 48 may drop down. In another example embodiment, sheet 48 may function as spring 24.

Figure 5:
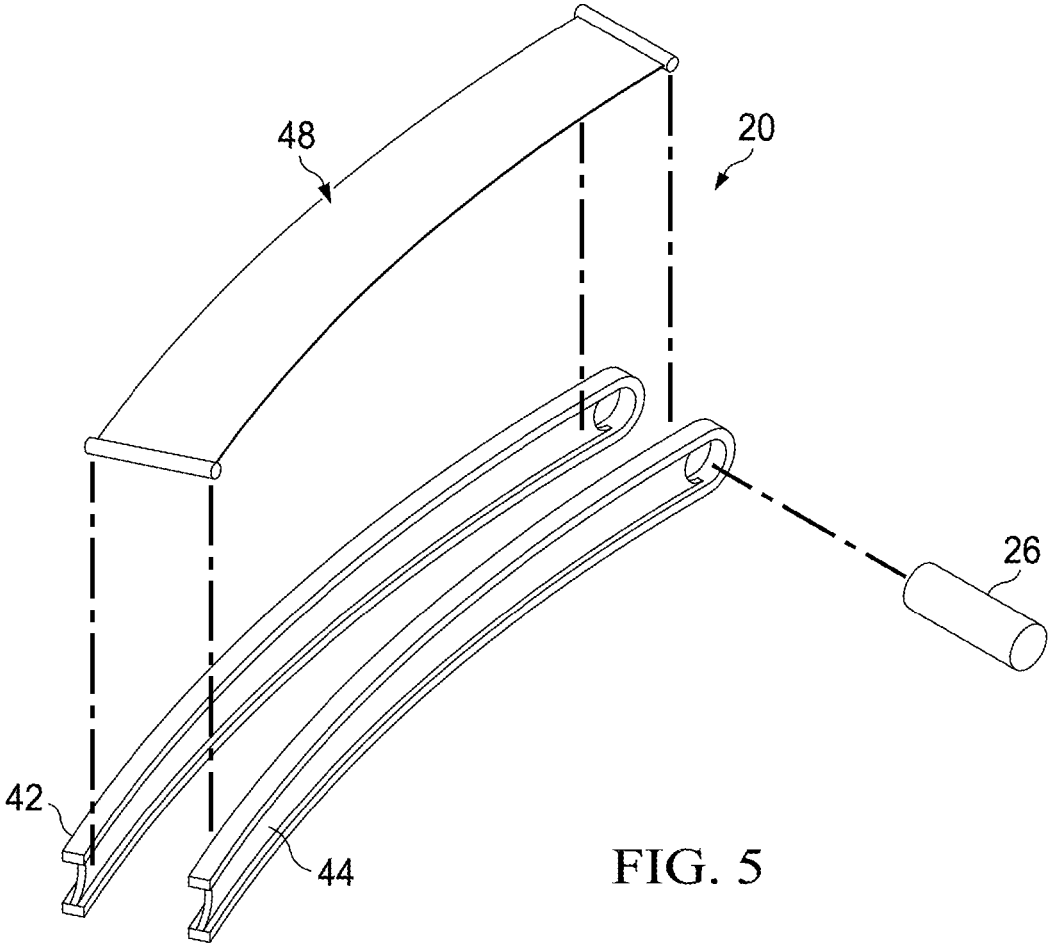
FIG. 5 is a simplified exploded view of a component of the system according to an example embodiment.

Turning to FIG. 5, FIG. 5 is a simplified exploded view of arm 20. Prongs 42 and 44 may include hollow spaces for sheet 48 to float up and down, for example, to accommodate different thickness of object 36. Lip 26 may be riveted to prongs 42 and 44, and may be used to connect prongs 42 and 44 into arm 20.

Figure 6:
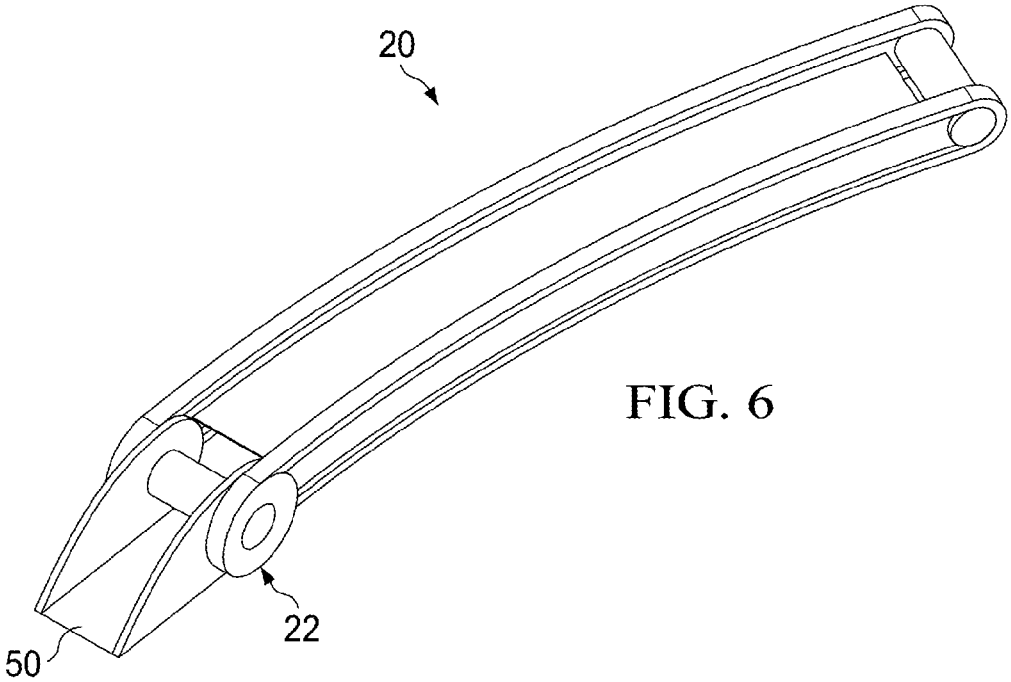
FIG. 6 is a simplified block diagram of a component of the bowl according to an example embodiment.

Turning to FIG. 6, FIG. 6 is a simplified block diagram of arm 20, illustrating an example embodiment of a connection with hinge 22. Arm 20 may be rotatable around hinge 22. A grip 50 may be provided in arm 20. Grip 50 may engender attachment of arm 20 and hinge 22 securely to rim 14. For example, grip 50 may be squeezed onto rim 14, so that clasp 18 is hingedly connected to rim 14. Clasp 18 may be re-tightened onto rim 14 by a simple squeeze. As used herein, the term "grip" includes any structure that is configured to permit clasp 18 to be attached to rim 14 with a pressure fastening, such as squeezing, spring loaded fastening and other such mechanisms.

Note that in this Specification, references to various features (e.g., elements, structures, modules, components, steps, operations, characteristics, etc.) included in "one embodiment", "example embodiment", "an embodiment", "another embodiment", "some embodiments", "various embodiments", "other embodiments", "alternative embodiment", and the like are intended to mean that any such features are included in one or more embodiments of the present disclosure, but may or may not necessarily be combined in the same embodiments.

It will be appreciated that substantial flexibility is provided by the system in that any suitable arrangements and configurations may be provided without departing from the teachings of the discussed concepts. Although the present disclosure has been described in detail with reference to particular arrangements and configurations, these example configurations and arrangements may be changed significantly without departing from the scope of the present disclosure. For example, although the present disclosure has been described with reference to a circular bowl and a spoon, system 10 may be applicable to other types of containers and objects, such as paint can and brush, and cooking pot and spatula.

While the disclosure references several particular embodiments, those skilled in the art will be able to make various modifications to the described embodiments without departing from the true spirit and scope of the disclosure. Numerous other changes, substitutions, variations, alterations, and modifications may be ascertained to one skilled in the art and it is intended that the present disclosure encompass all such changes, substitutions, variations, alterations, and modifications as falling within the scope of the appended claims. It is intended that all elements or steps which are insubstantially different from those recited in the claims but perform substantially the same functions, respectively, in substantially the same way to achieve the same result as what is claimed are within the scope of the disclosure.

Numerous other changes, substitutions, variations, alterations, and modifications may be ascertained to one skilled in the art and it is intended that the present disclosure encompass all such changes, substitutions, variations, alterations, and modifications as falling within the scope of the appended claims. In order to assist the United States Patent and Trademark Office (USPTO) and, additionally, any readers of any patent issued on this application in interpreting the claims appended hereto, Applicant wishes to note that the Applicant: (a) does not intend any of the appended claims to invoke paragraph six (6) of 35 U.S.C. section 112 as it exists on the date of the filing hereof unless the words "means for" or "step for" are specifically used in the particular claims; and (b) does not intend, by any statement in the specification, to limit this disclosure in any way that is not otherwise reflected in the appended claims.

What is claimed is:

1. A bowl, comprising:

a circular rim having a recess, wherein the bowl has a depth defined by a sidewall and an inner bottom surface; and a clasp configured to extend across the recess in order to close the recess and to inhibit movement of a handle of an object that rests on a surface of the recess;

wherein:

at least a portion of the inner bottom surface is uneven for receiving a head portion of the object, wherein the clasp is hinged and rotatable between a first configuration associated with the recess being closed, and a second configuration associated with the recess being open and ready to receive the handle;

a first magnetic material is disposed on at least a portion of the inner bottom surface to attract the head portion of the object;

a second magnetic material is disposed on the recess to attract the handle of the object; and the clasp includes an arm comprising a first prong, a second prong, and a sheet positioned between the first prong and the second prong adapted to move up and down.

2. The bowl of claim 1, wherein the clasp operates in the first configuration when a downward force is applied to the clasp and against the circular rim such that the object is secured within the recess.

3. The bowl of claim 1, wherein the clasp operates in the second configuration when a downward force is applied to the clasp and against the circular rim such that the clasp is secured in a groove of the bowl.

4. The bowl of claim 1, wherein the circular rim includes a groove configured to receive a lip on the clasp such that in the first configuration, the lip is engaged with the groove.

5. The bowl of claim 4, wherein the circular rim includes an additional groove configured to receive the lip such that in the second configuration, the lip is engaged with the additional groove.

6. The bowl of claim 1, wherein the clasp includes a spring configured to press against an object placed in the recess.

7. The bowl of claim 1, wherein the spring is a leaf spring.

8. The bowl of claim 1, wherein the object is a spoon.

9. The bowl of claim 1, wherein the first prong and the second prong each includes a hollow space; and the sheet positioned between the first prong and the second prong is provided in the hollow spaces, such that the sheet can float up and down.

10. The bowl of claim 1, wherein the clasp includes a grip.

11. A bowl, comprising:

a circular rim having a recess, wherein the bowl has a depth defined by a sidewall and an inner bottom surface, and wherein a first magnetic material is disposed on at least a portion of the inner bottom surface; and a clasp configured to extend across the recess in order to close the recess and to inhibit movement of a handle of an object that rests on a surface of the recess;

wherein:

at least a portion of the inner bottom surface is uneven for receiving a head portion of the object;

the clasp is hinged and rotatable between a first configuration associated with the recess being closed, and a second configuration associated with the recess being open and ready to receive the object;

the circular rim includes a groove configured to receive a lip on the clasp such that in the first configuration, the lip is engaged with the groove;

the circular rim includes an additional groove configured to receive the lip such that in the second configuration, the lip is engaged with the additional groove;

a second magnetic material is disposed on the recess to attract the handle of the object; and the clasp includes an arm comprising a first prong, a second prong, and a sheet positioned between the first prong and the second prong adapted to move up and down.

12. A bowl, comprising:

a circular rim having a recess, wherein the bowl has a depth defined by a sidewall and an inner bottom surface; and a clasp configured to extend across the recess in order to close the recess and to inhibit movement of a handle of an object that rests on a surface of the recess;

wherein:

at least a portion of the inner bottom surface is uneven for receiving a head portion of the object, wherein the clasp is hinged and rotatable between a first configuration associated with the recess being closed, and a second configuration associated with the recess being open and ready to receive the handle;

the clasp includes an arm comprising a first prong and a second prong;

the first prong and the second prong each includes a hollow space; and the clasp further includes a sheet positioned between the first prong and the second prong in the hollow spaces, such that the sheet can float up and down.

13. The bowl of claim 12, wherein the sheet functions as a spring for pressing against the handle of the object.

14. The bowl of claim 12, wherein the sheet holds the object securely in position when the clasp is in the first configuration associated with the recess being closed.

15. The bowl of claim 12, wherein:

when the clasp is in the first configuration associated with the recess being closed, the object pushes the sheet upwards away from the bowl and the sheet is positioned towards an upper portion of the first prong and the second prong.

16. The bowl of claim 12, wherein the sheet floats up and down in the hollow spaces to accommodate different thickness of the object.

17. The bowl of claim 12, wherein the clasp further includes a lip riveted to the first prong and the second prong, and the lip connects the first prong and the second prong into the arm.

18. The bowl of claim 12, wherein the arm further includes a grip attached to the first prong and the second prong via a hinge and the grip is configured to permit the clasp to be attached to the circular rim with a pressure fastening.

* * * * *